United States Patent [19]

Lincoln et al.

[11] Patent Number: 4,817,358

[45] Date of Patent: Apr. 4, 1989

[54] ASPHALT SHINGLE WITH FOAMED ASPHALT LAYER UNDER TABS

[75] Inventors: William W. Lincoln; Stephen J. Jones, both of Newark, Ohio

[73] Assignee: Owens-Corning Fiberglas Corporation, Toledo, Ohio

[21] Appl. No.: 514,433

[22] Filed: Jul. 18, 1983

[51] Int. Cl.[4] ..... E04D 1/28

[52] U.S. Cl. ..... 52/557; 52/420; 428/291

[58] Field of Search ..... 52/557, 543, 420, 314, 52/553, 555, 232, 419, 309.5; 428/291; 427/286, 373, 200; 521/154

[56] References Cited

U.S. PATENT DOCUMENTS

| | | | |
|---|---|---|---|
| 1,722,702 | 8/1925 | Kirschbraun et al. . | |
| 1,756,989 | 4/1926 | Overbury . | |
| 2,009,617 | 7/1935 | Harshberger | 52/553 |
| 2,142,181 | 12/1936 | Croce . | |
| 2,170,534 | 12/1937 | MacNutt . | |
| 2,356,570 | 12/1940 | Deuchler . | |
| 2,724,872 | 11/1955 | Herbes | 52/553 |
| 2,863,405 | 12/1958 | Leibrook et al. | 52/420 |
| 3,468,092 | 9/1969 | Chalmers | 52/314 X |
| 3,613,328 | 10/1971 | Morgan, Jr. et al. | 52/555 |
| 4,137,198 | 1/1979 | Sachs | 521/154 |
| 4,186,236 | 1/1980 | Hetmann | 428/291 |
| 4,188,763 | 2/1980 | Thiis-Evensen | 52/557 |
| 4,195,461 | 4/1980 | Thiis-Evensen | 52/557 |
| 4,399,186 | 8/1983 | Lauderback | 428/291 |
| 4,405,680 | 9/1983 | Hansen | 428/291 X |
| 4,470,237 | 9/1984 | Lincoln et al. | 52/420 |

FOREIGN PATENT DOCUMENTS

| | | | |
|---|---|---|---|
| 602248 | 7/1960 | Canada | 52/557 |
| 690501 | 7/1964 | Canada | 52/232 |
| 105177 | 11/1966 | Denmark | 52/557 |

OTHER PUBLICATIONS

*Asphalts,* Herbert Abraham, vol. 1, 1945 Fifth ed., Chapter XXVII, pp. 582, 629, 630.

*Primary Examiner*—John E. Murtagh
*Assistant Examiner*—Richard E. Chilcot, Jr.
*Attorney, Agent, or Firm*—Ted C. Gillespie

[57] ABSTRACT

The underside of the tab portion of an asphalt shingle is provided with a layer of foamed asphalt. The foamed asphalt layer may be continuous or discontinuous.

5 Claims, 2 Drawing Sheets

ASPHALT SHINGLE WITH FOAMED ASPHALT LAYER UNDER TABS

TECHNICAL FIELD

This invention relates generally to asphalt shingles, and more particularly to asphalt shingles having an extra layer of material on the underside of the tabs to provide an enhanced relief effect on a roof.

BACKGROUND ART

U.S. Pat. Nos. 4,188,763 and 4,195,461 disclose asphalt shingles wherein a layer of spheres of expanded polystyrene is provided on the underside of the tabs. The expanded polystyrene spheres are expensive, hard to obtain, and difficult to process.

DISCLOSURE OF INVENTION

In accordance with the invention, conventional asphalt shingles are provided with an additional layer of foamed asphalt on the underside of the tabs. The additional layer may be continuous or discontinuous.

BRIEF DESCRIPTION OF THE DRAWINGS

The invention is hereinafter more fully described with reference to the accompanying drawings in which.

BEST MODE OF CARRYING OUT THE INVENTION

Figure 1:
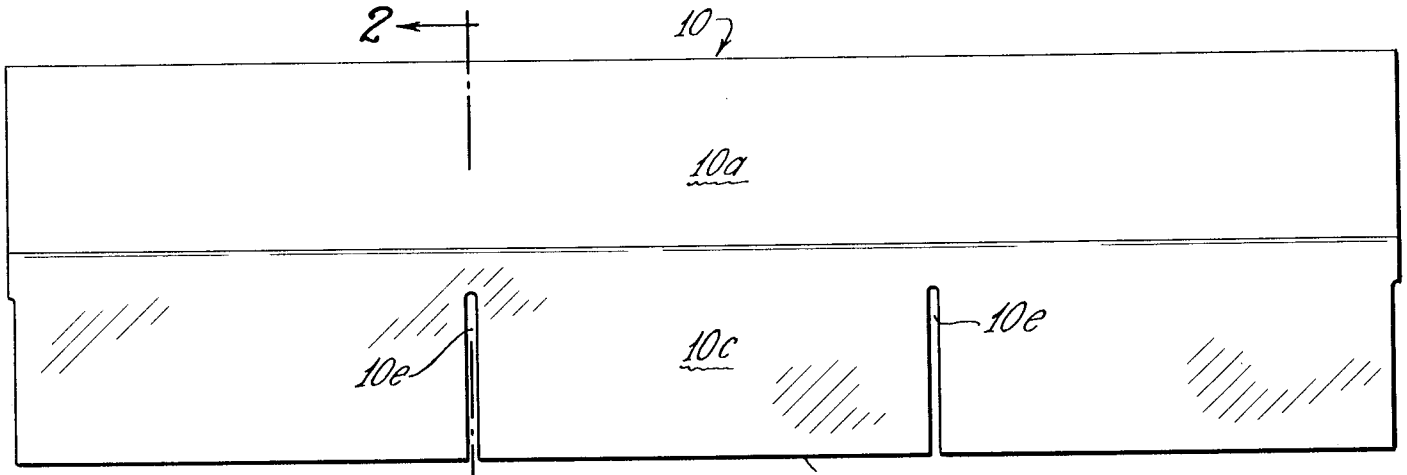
FIG. 1 is a view of the underside of a shingle constructed in accordance with the invention.
Figure 2:
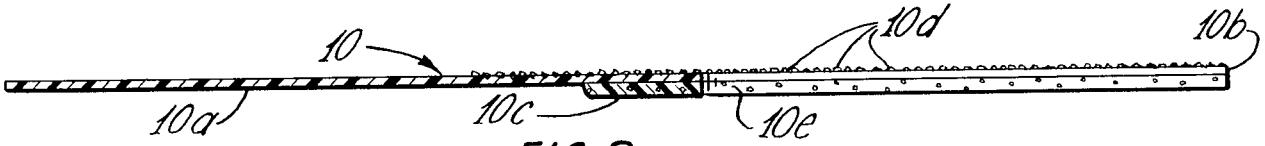
FIG. 2 is an enlarged sectional view taken along the line 2—2 of FIG. 1.

With reference to the drawings, FIGS. 1 and 2 show a shingle 10 constructed in accordance with the invention. The shingle 10 consists essentially of a conventional asphalt shingle including a headlap portion 10*a* and a normally exposed tab portion 10*b*, with the improvement of a continuous layer of foamed asphalt 10*c* on the underside of the tab portion 10*b*.

Figure 3:
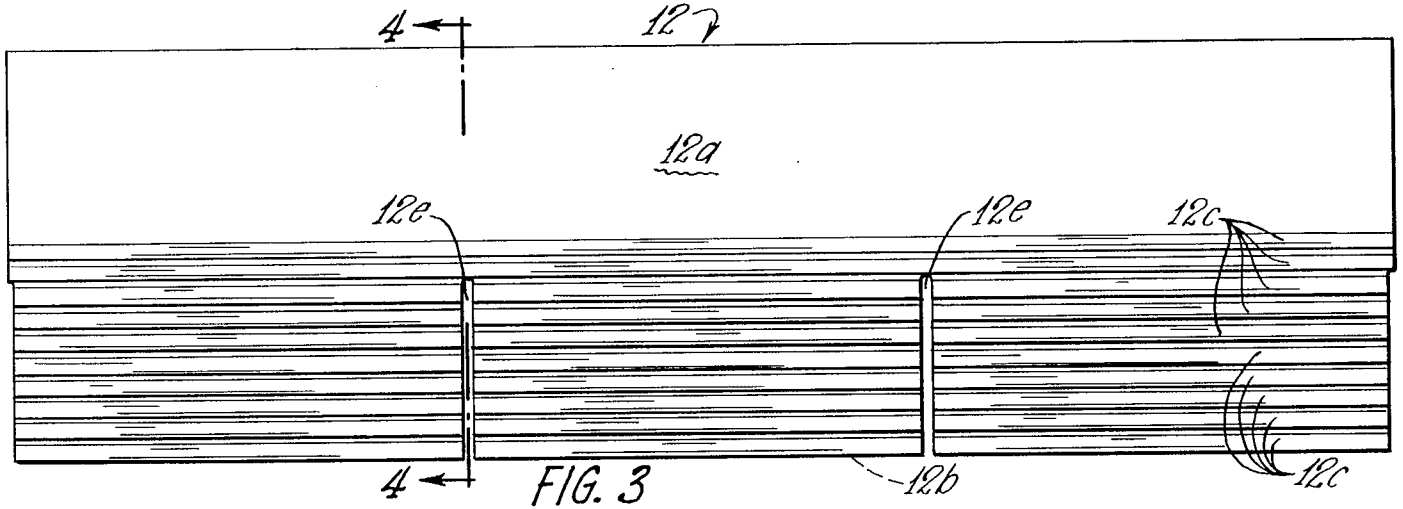
FIG. 3 is a view of the underside of a shingle forming an alternative embodiment of the invention.
Figure 4:
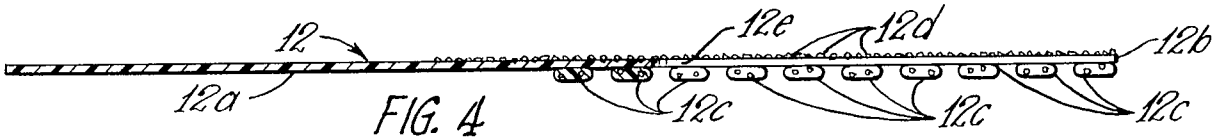
FIG. 4 is an enlarged view taken along the line 4—4 of FIG. 3.

FIGS. 3 and 4 show a shingle 12 constructed in accordance with the invention. The shingle 12 consists essentially of a conventional asphalt shingle including a headlap portion 12*a* and a normally exposed tab portion 12*b*, with the improvement of a layer in the form of spaced, parallel continuous beads or strips 12*c* of foamed asphalt on the underside of the tab portion 12*b*.

Figure 5:
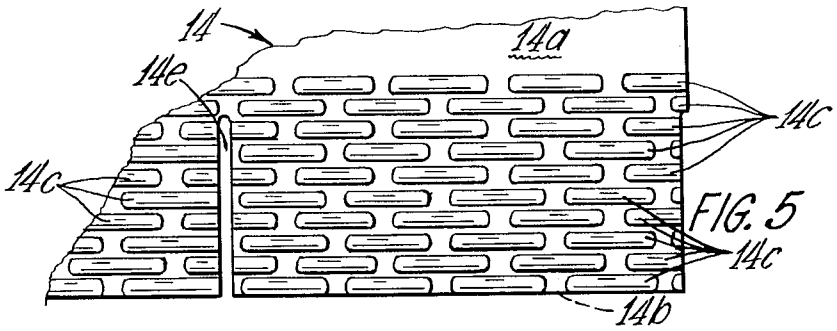
FIG. 5 is a fragmentary view of the underside of a shingle forming still another embodiment of the invention.

FIG. 5 shows a shingle 14 similar to the shingle 12, but instead of the continuous beads or strips 12*c*, the shingle 14, which has a headlap portion 14*a* and a normally exposed tab portion 14*b*, is provided with broken or discontinuous spaced, parallel beads or strips 14*c* of foamed asphalt on the underside of the tab portion 14*b*.

Each of the shingles 10, 12, and 14 includes a reinforcing mat (not shown), as is well understood by those skilled in the art. Preferably, the mat is glass fiber mat. The normally exposed tab portions 10*b*, 12*b*, and 14*b* are covered on their upper sides with decorative granules, such as granules 10*d* and 12*d* illustrated respectively in FIGS. 2 and 4. The tab portions 10*b*, 12*b*, and 14*b* are typically provided respectively with slots 10*e*, 12*e*, and 14*e* for subdivision thereof into smaller tabs.

The foamed asphalt layer 10*c* and the foamed asphalt strips 12*c* and 14*c* may be extruded into place through suitable dispensing nozzles, before the shingles are cut. Before its application to the shingle material, the asphalt may be foamed in a high-shear mixer of the type available from EASE, INC. of Tunnel Hill, Ga. 30755, in which air or an inert gas such as nitrogen is introduced and radial pins on a rotor are rapidly rotated in interleaving relationship with stationary pins on a stator, while the liquid being foamed flows axially of the rotor. A filler such as limestone dust and a polymer modifier such as styrene or rubber may be added to the asphalt before the foaming thereof if desired. Foaming can be carried out at an asphalt temperature of 250° to 450° F.

The foamed asphalt layers under the tab portions 10*b*, 12*b*, and 14*b* provide added thickness which enhances the appearance of the shingles on a roof. However, the layers are thin enough to solidify in the foamed state. Broken sections of the foamed asphalt have a dull gray appearance, indicating the presence of bubbles too small to be seen by the naked eye. By comparison, broken sections of non-foamed asphalt have a shiny black appearance. The foaming saves greatly on the amount of asphalt used.

Various modifications may be made in the structures shown and described without departing from the scope of the invention. While only two discontinuous patterns for the foamed asphalt layer have been shown in addition to the continuous layer, other discontinuous patterns are also within the scope of the invention, such as random irregular patterns, for example.

We claim:

1. An improved asphalt shingle comprising an asphalt shingle having a headlap portion and a normally exposed tab portion, with the improvement of a layer of foamed asphalt substantially covering an underside of the tab portion, the layer of foamed asphalt being of sufficient thickness at least at a free end portion of the tab portion to provide an enhanced relief effect when the shingle is installed on a roof, said free end portion of the tab portion being an end portion thereof remote from said headlap portion as distinct from an end portion thereof attached to said headlap portion.

2. An asphalt shingle as claimed in claim 1, wherein the foamed asphalt layer is a continuous layer.

3. An asphalt shingle as claimed in claim 1, wherein the foamed asphalt layer is a discontinuous layer.

4. An asphalt shingle as claimed in claim 1, wherein the foamed asphalt layer is a plurality of spaced, parallel continuous strips.

5. An asphalt shingle as claimed in claim 1, wherein the foamed asphalt layer is a plurality of spaced, parallel discontinuous strips.

* * * * *